US007339486B2

(12) United States Patent
Huang

(10) Patent No.: US 7,339,486 B2
(45) Date of Patent: Mar. 4, 2008

(54) INSERTION TYPE FUSE WITH BREAKAGE INDICATION

(75) Inventor: Jung-Sheng Huang, Taipei Hsien (TW)

(73) Assignee: Hansor Polymer Technology Corp., Zhonghe City, Taipei County (TW)

( * ) Notice: Subject to any disclaimer, the term of this patent is extended or adjusted under 35 U.S.C. 154(b) by 69 days.

(21) Appl. No.: 11/368,163

(22) Filed: Mar. 6, 2006

(65) Prior Publication Data

US 2007/0217109 A1 Sep. 20, 2007

(51) Int. Cl.
*G08B 21/00* (2006.01)

(52) U.S. Cl. ..... 340/638; 340/657; 200/308; 337/158

(58) Field of Classification Search ..... 340/638
See application file for complete search history.

(56) References Cited

U.S. PATENT DOCUMENTS 4,387,358 A * 6/1983 Knapp, Jr. ..... 337/244
5,598,138 A * 1/1997 Jaronczyk, Jr. ..... 337/265
6,522,234 B1 * 2/2003 Sturgill ..... 337/198

* cited by examiner

*Primary Examiner*—George Bugg

(57) ABSTRACT

An insertion type fuse with breakage indication comprises a seat having a long receiving chamber for receiving a metal fuse; an rectangular bi-directional SMD form LED set being located on the buckle portions; the LED set being a coating device and being high temperature tolerant; the LED set being connected to a circuit; the LED including two LEDs and being serially connected with a voltage divided resistor; a fuse wire being connected between the LED set and a load; the LED set being buckled to the buckle portions; when the fuse wire breaks, light will emit out so as to show that the fuse wire breaks; thereby a break fuse can be fined rapidly. In assembly, the seat and the cover are integrally formed. The LED set is adhered to the metal fuse and then the metal fuse is assembled into the long receiving chamber.

2 Claims, 8 Drawing Sheets

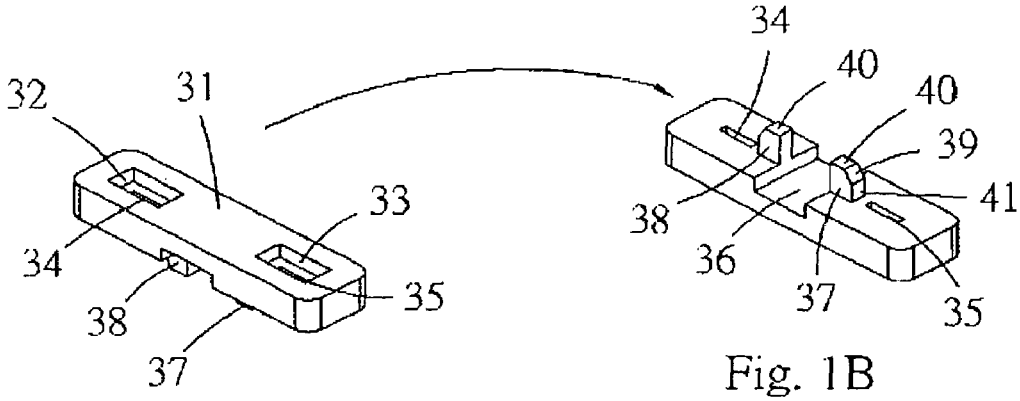
Fig. 1B
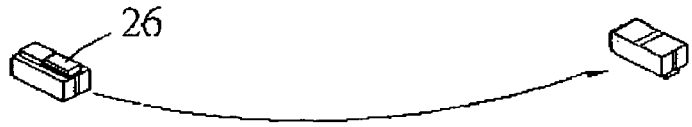
Fig. 1C
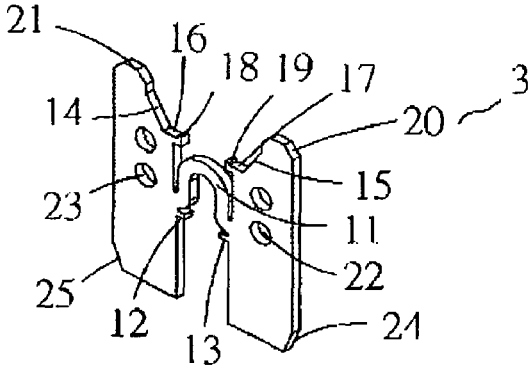
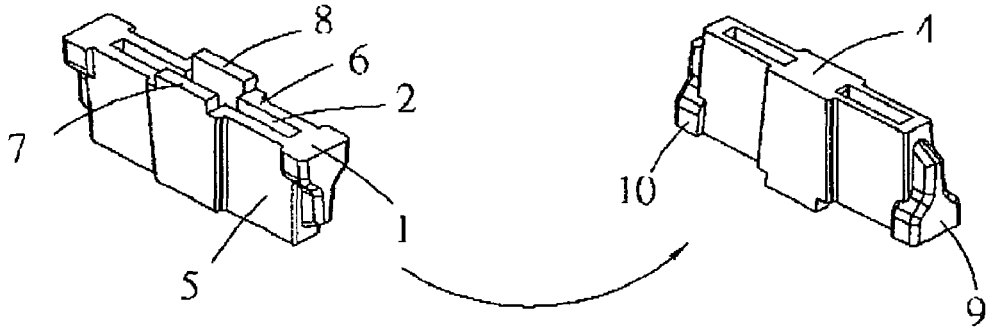
Fig. 1A
Fig. 1D

INSERTION TYPE FUSE WITH BREAKAGE INDICATION

FIELD OF THE INVENTION

The present invention relates to an insertion type fuse with breakage indication, wherein a bi-directional SMD LED set is used so that the fuse can be used bi-directionally. The assembly of the present invention is easy and can be produced automatically with higher production rate and lower cost.

BACKGROUND OF THE INVENTION

In the prior art fuse, a small bulb is connected between two metal electrodes. The bulb has a larger resistor which is greater than that of the fuse so that current only flows through the fuse instead of the bulb. Thus the bulb will not light up. When the fuse breaks due to overload, the current flows through the bulb so that the bulb will lightup. However the prior art bulb easily burns so that the current with over-current can no be formed easily. Thus the repair work needs a long time. Thereby the bulb in the prior art is protruded from the conventional fuse structure so that it is not suitable to be installed within a car.

"Blade fuses" have now substantially replaced the tubular glass fuses that were once standard in the automotive industry. A disadvantageous feature of such blade fuses is however that, when installed in a fuse block, the fusible element or link is hidden from view. Locating a blown fuse therefore normally entails withdrawal of the fuses from the block, one-by-one until the defective fuse is found.

In one prior art, U.S. Pat. No. 5,598,138, a fault-indicating blade fuse is disclosed. The fuse comprises a relatively thin and flat, generally rectangular, dielectric body defined by top, bottom and opposite side margins, and having an upper portion of long, narrow profile, taken in transverse cross section; a pair of generally parallel metal blades projecting downwardly beyond the bottom margin of the body; a link within the body electrically interconnecting the blades and being fusible to break the interconnection when subjected to current exceeding a rated value; and a light-emitting electrical device positioned for ready visibility from above the fuse and lying within the bounds of the upper body profile, the light-emitting device being so constructed and so connected to the blades as to be activated, for light emission, upon fusion of the link when subjected to such excessive current. The light-emitting device is selected from the group consisting of incandescent lamps and at least one light-emitting diode. Furthermore, the light-emitting device comprises first and second light-emitting diodes connected in parallel and biased for passage of direct current between the blades in opposite directions, the diodes thereby affording dual polarity to the fault-indicating feature of the fuse.

However this prior art is a unidirectionally device. In installation, the fuse must be placed in a predetermined orientation. This induces a trouble in the installation. Furthermore, the LED is not firmly secured to the fuse. The fuse wire is welded to the fuse plate so that the connection of the prior art is not tight. However all these are necessary to be improved.

SUMMARY OF THE INVENTION

Accordingly, the primary object of the present invention is to provide an insertion type fuse with breakage indication, wherein a bi-directional SMD LED set is used so that the fuse can be used bi-directionally. The assembly of the present invention is easy and can be produced automatically with a higher production rate and a lower cost.

To achieve above objects, the present invention provides an insertion type fuse with breakage indication which comprising: a seat having a long receiving chamber for receiving a metal fuse; an rectangular bi-directional SMD form LED set being located on the buckle portions; the LED set being a coating device and being high temperature tolerant; the LED set being connected to a circuit; the LED including two LEDs and being serially connected with a voltage divided resistor; a fuse wire being connected between the LED set and a load; the LED set being buckled to the buckle portions; when the fuse wire breaks, light will emit out so as to show that the fuse wire breaks; thereby a break fuse can be fined rapidly. In assembly, the seat and the cover are integrally formed. The LED set is adhered to the metal fuse and then the metal fuse is assembled into the long receiving chamber.

The various objects and advantages of the present invention will be more readily understood from the following detailed description when read in conjunction with the appended drawing.

BRIEF DESCRIPTION OF THE DRAWINGS

FIG. 1 is an exploded view of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 2:
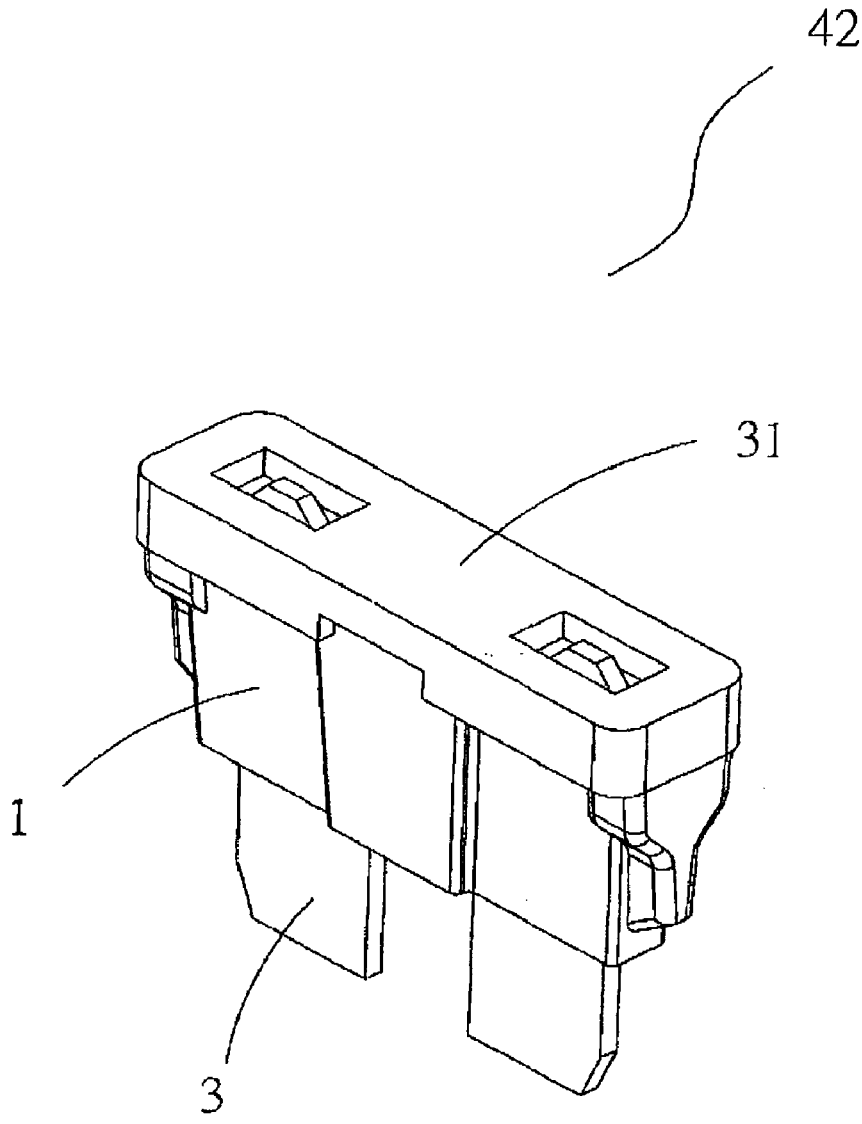
FIG. 2 is an assembled view of the present invention.

Referring to FIGS. 1 and 2, the inserting fuse with a break indication of the present invention is illustrated. The present invention has the following elements.

A seat 1 has a long receiving chamber 2 for receiving a metal fuse 3. A middle section of the long receiving chamber 2 is wider and two ends of the long receiving chamber 2 are narrow. Two opposite sides of the seat 1 are two protecting plates 5 and 6. Each protecting plate has a rectangular ear 7, 8 at an upper middle section thereof. Another two opposite sides of the seat 1 are formed with Y shape protruding sheets 8, 9. A U shape isolating plate 4 clamps the two protecting plates 5 and runs across an opening of the long receiving chamber 2.

A metal fuse 3 includes two larger sheets and a meltable line 11 serves to connect the two sheets. A tenon 12, 13 is formed at each of the connections of the larger sheet and the meltable line 11. In assembly, the metal fuse 3 is received within the long receiving chamber 2 and are spaced by the isolating plate 4 so that the two tenons 12, 13 clamp the two sides of the isolating plate 4. An upper edge of each larger sheet is chamfered to have an inclined edge 14, 15. A lowest edge of each inclined surface 14, 15 is formed with a transversally protruded buckle portion 16, 17. Each buckle portion 16, 17 has an upward extended nose 18, 19. An outer side of each larger sheet is formed with outer chamfered surfaces 20, 21, 24, and 25. A rectangular bi-directional SMD (surface mounting form) LED set 26 is located on the buckle portions 16, 17.

Figure 7:
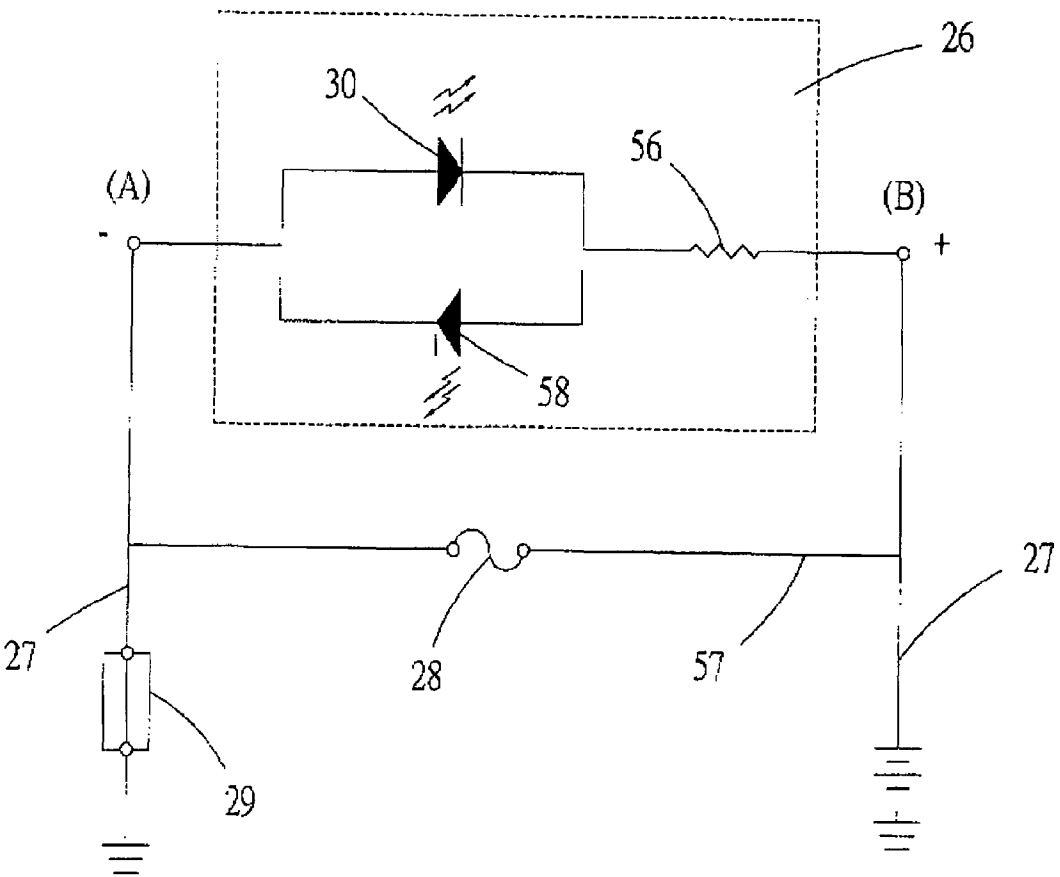
FIG. 7 shows a first circuit diagram of the present invention.
Figure 8:
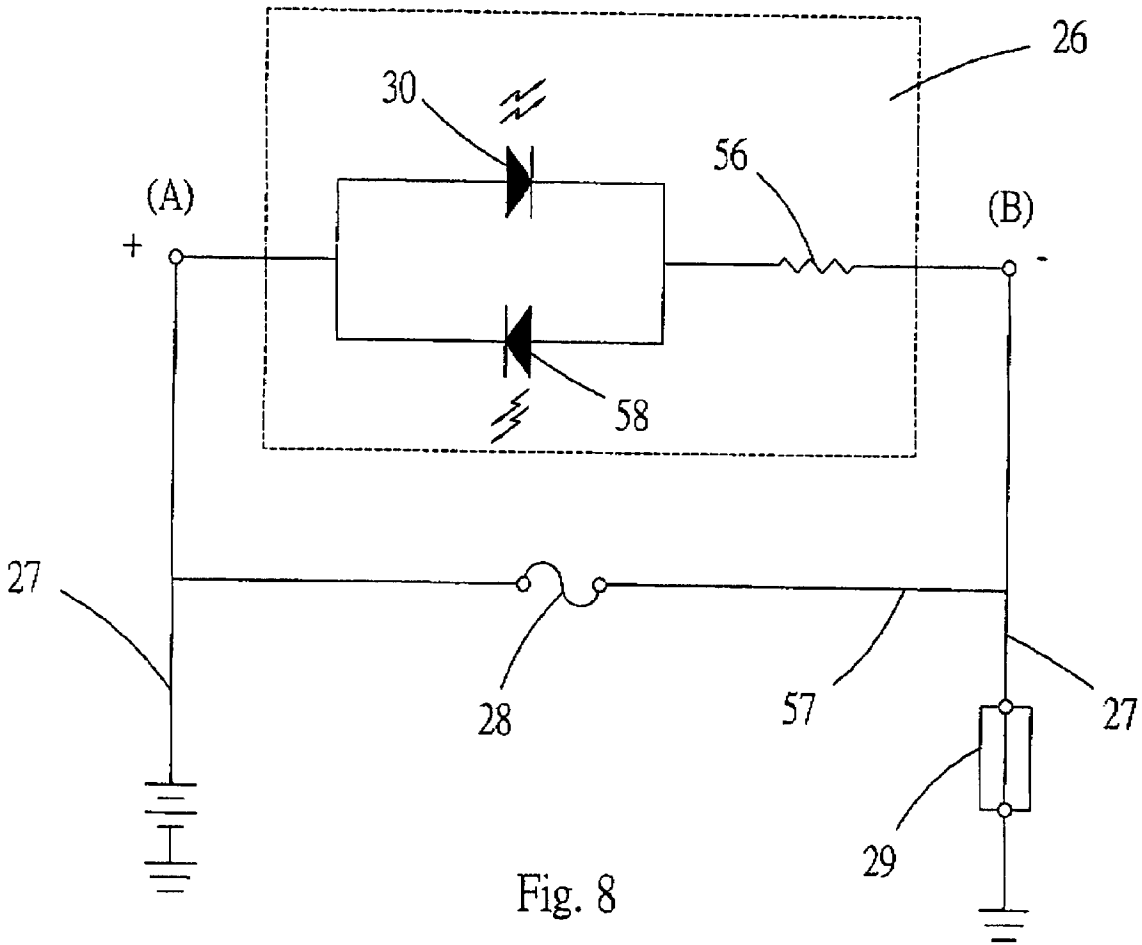
FIG. 8 shows a second circuit diagram of the present invention.

Referring to FIGS. 7 and 8, The LED set is a coating device and is high temperature tolerant. The LED set is connected to a circuit 27. In the drawing, it is illustrated that the LED 26 includes two LEDs 30, 58 and is serially connected with a voltage divided resistor 56. A fuse wire 28 is connected between the LED set 26 and a load 29. The LED set 26 is buckled to the buckle portions 16, 17. When the fuse wire 58 breaks, light will emit out so as to show that the fuse wire 28 breaks. Thereby a break fuse can be fined rapidly. If the end B is connected to the positive side (as illustrated in FIG. 7), the LED 58 will conduct and light up as the fuse wire breaks. If the end A is connected to the positive side (as illustrated in FIG. 8), the LED 30 will conduct and light up as the fuse wire breaks.

A cover 31 covers upon the seat 1. The cover 31 has two symmetrical grooves 32, 33 so that the upper ends of the larger sheets of the metal fuse 3 pass through openings 34, 35 of the groove 32, 33, respectively. A middle section of the lower side of the cover 31 is formed with a long slot 36 for receiving the two rectangular ears 7, 8. Two sides of the slot 36 are formed with two tenons 37, 38, respectively. Each tenon is formed with three edges 39, 40 and 41 so that the upper cover can be tightly closed.

In assembly, the metal fuse 3 is located within the seat 1 and the cover 31 cover upon one side of the seat 1 so as to form the structure 42 of the present invention, as illustrated in FIG. 2.

Figure 3B:
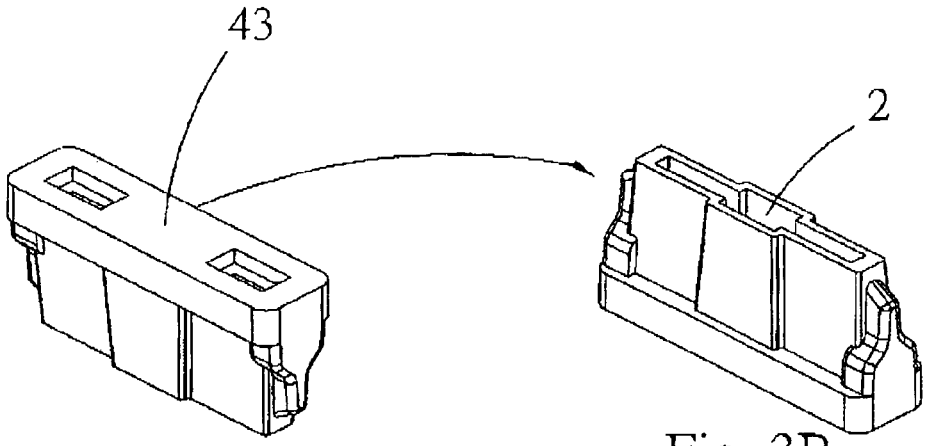
FIG. 3 shows another embodiment of the present invention.
Figure 3C:
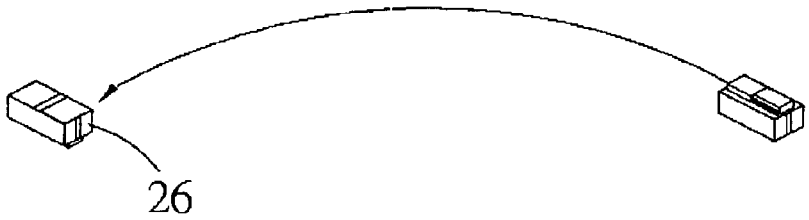
Figure 3A:
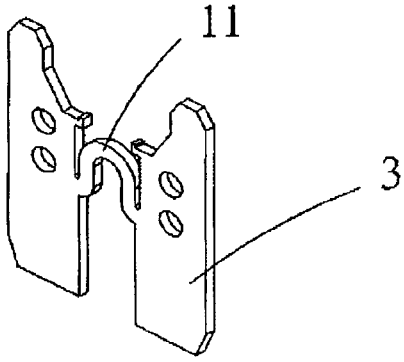
Figure 4:
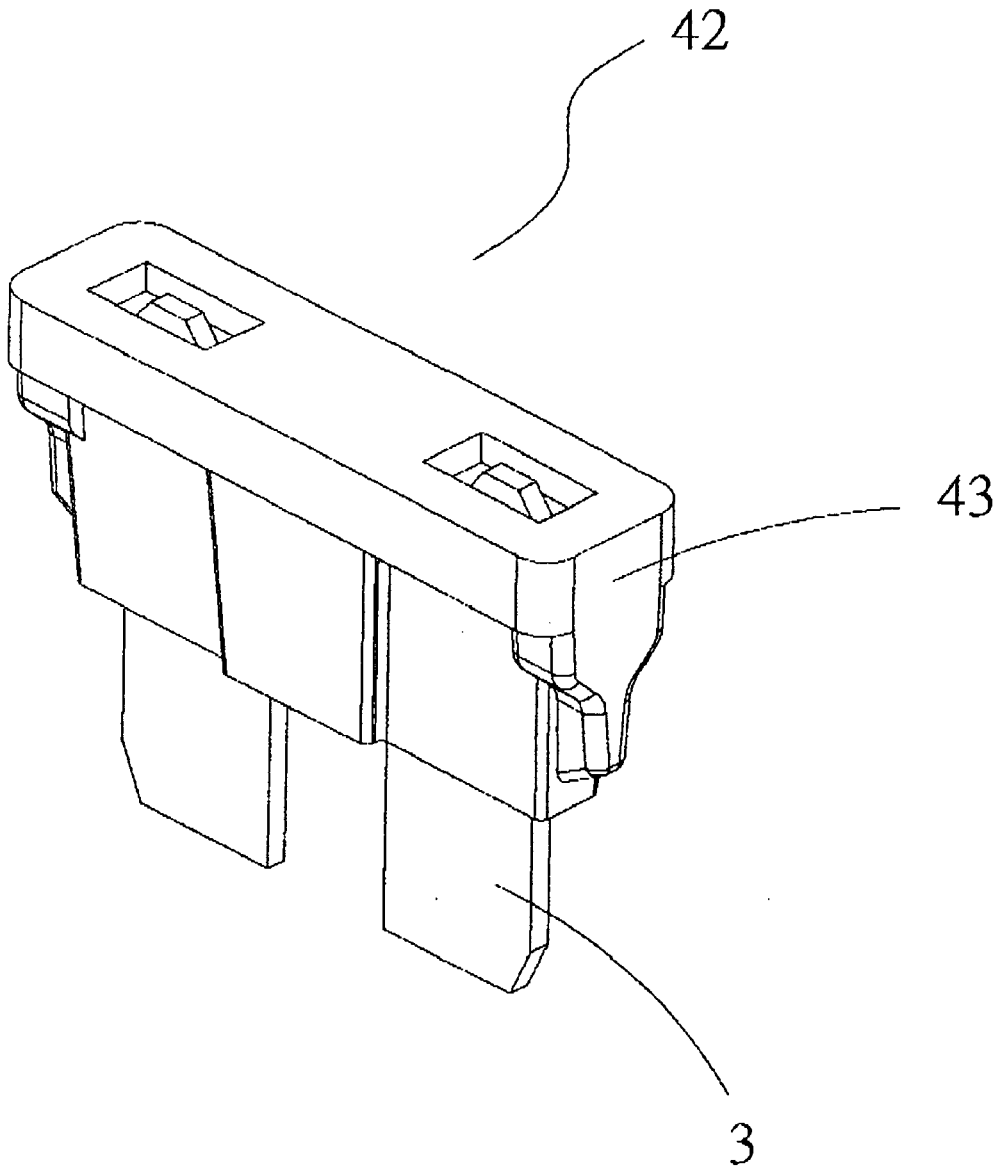
FIG. 4 is the assembled view for the structure in FIG. 3.

Besides, in the present invention, the seat 1 and the cover 31 can be integrally formed (see FIGS. 3 and 4). The LED set 26 is adhered to the metal fuse 3 and then the metal fuse 3 is assembled into the long receiving chamber 2.

Figures 5A, 5B:
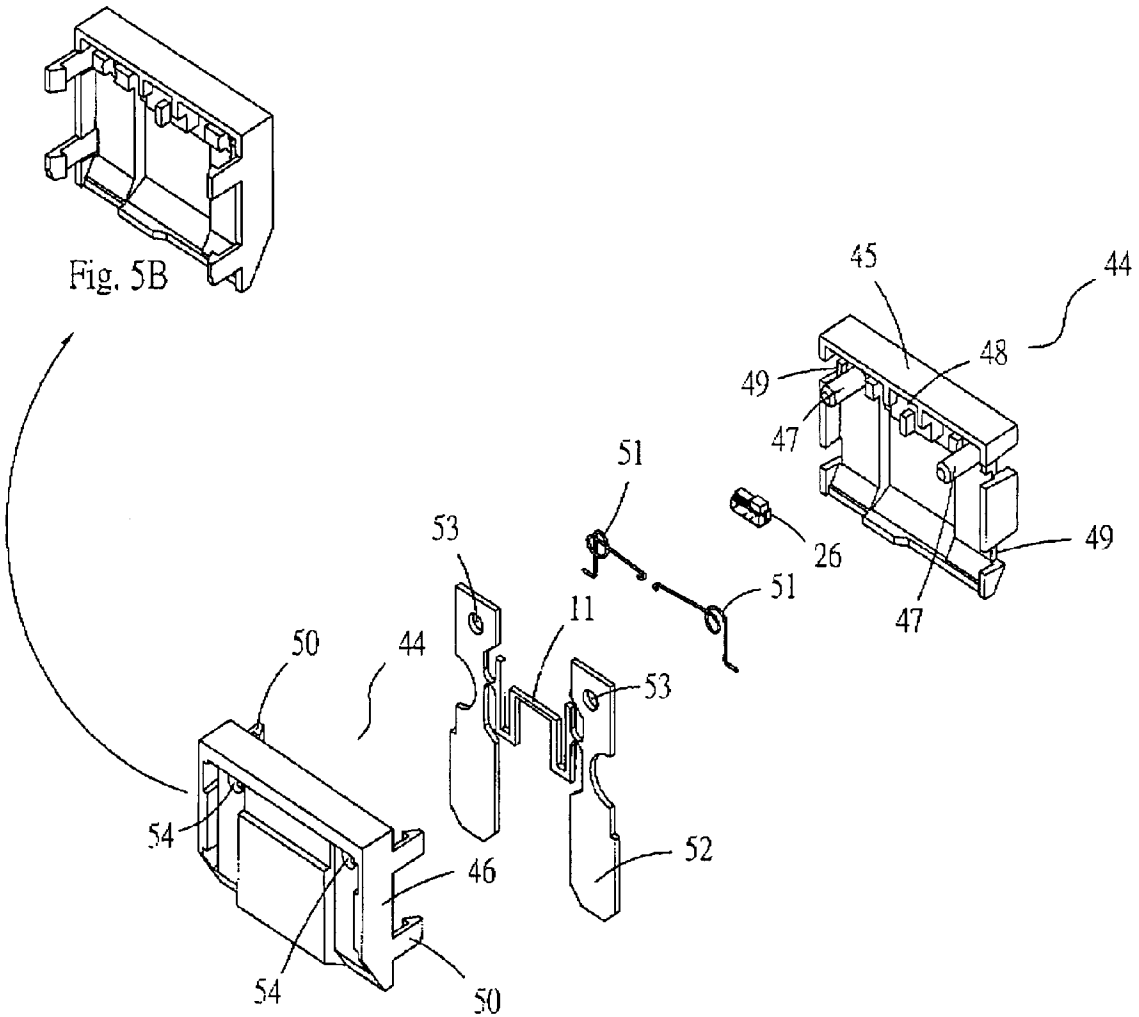
FIG. 5 is an exploded perspective view about a further embodiment of the present invention.
Figure 6:
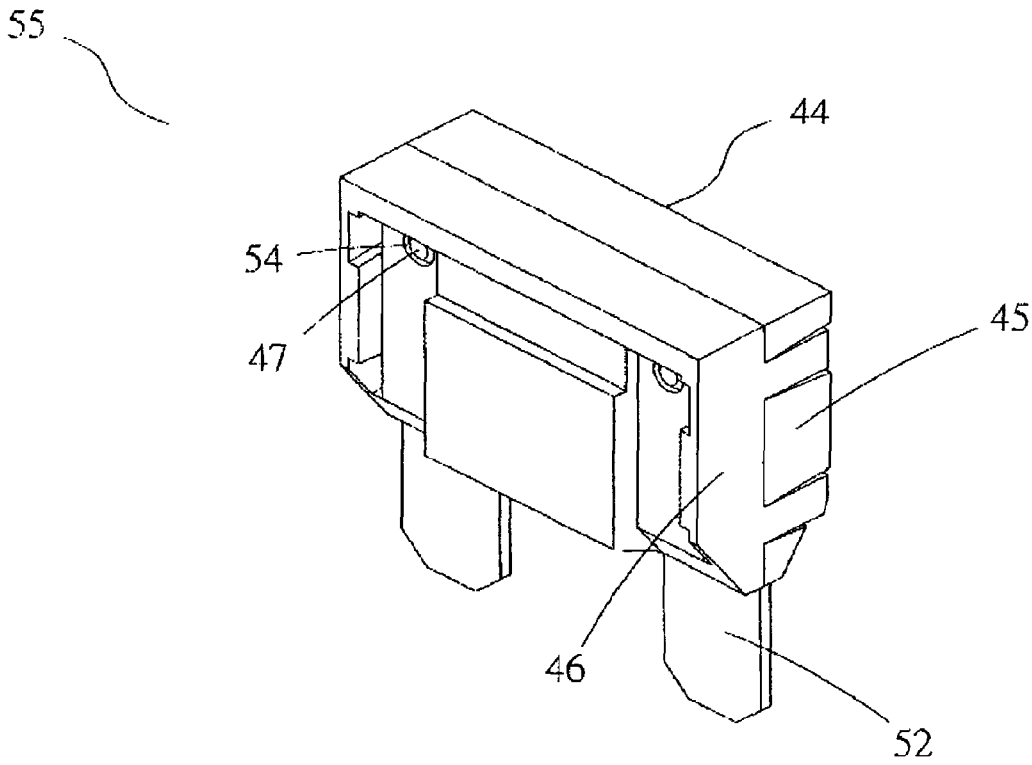
FIG. 6 is an assembled view of the structure illustrated in FIG. 5.

Referring to FIGS. 5, and 6, another embodiment of the present invention is illustrated. In the present invention there are two covers, a bottom cover 45 and a buckling cover 46. The bottom cover 45 has two posts 47 at the inner two sides, a receiving chamber 48 and buckling recess 49 at lateral sides. The buckling cover 46 has a plurality of hooks 50. The posts 47 are installed with springs 51.

A bi-directional SMD LED set 26 is installed between the two springs 51 so as to be received in the receiving chamber 48.

A metal fuse 52 has two larger sheets. Each larger sheet has a via hole 53 for receiving the post 47 so that the metal fuse 52 is conductive to the springs 51.

The buckling cover 46 has two through holes 54 for receiving the two posts 47 after passing through the two springs 51. The buckling cover 46 has a plurality of buckling pins 50 corresponding to the buckling recesses 49 so that the pins 60 can be received in the buckling recesses 49.

Advantages of the present invention will be stated herein. In the present invention, a bi-directional SMD LED set is used so that the fuse can be used bi-directionally. Moreover since LED is used so that it is suitable to the voltage range connected 12V to 17V, but the prior art tungsten fuse only suffers from a voltage range of 16V. Furthermore, the assembly of the present invention is easy and can be produced automatically with a higher production rate and a lower cost. Moreover the cover of the present invention has a flat outer surface so that assembled work is easy and the update operation can be performed easily and quickly. Further the cost of making the mold of the fuse of the present invention is low. The power consumption of the present invention is only one-eighth of the conventional fuse with tungsten light. Thus the power is saved. Furthermore, the present invention is heat tolerant and the destroyed fuse can be displayed clearly.

However, in the present invention the LED set is firmly secured to the metal fuse so that the structure of the present invention is very concrete. Furthermore, the bi-directional SMD LED set is used so that the fuse can be used bi-directionally. These advantages cannot be achieved by any prior art.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An insertion type fuse with breakage indication comprising:

a seat having a long receiving chamber; a middle section of the long receiving chamber being wider and two ends of the long receiving chamber being narrow; two opposite sides of the seat being two protecting plates; each protecting plate having a rectangular ear at an upper middle section thereof; another two opposite sides of the seat being formed with Y shape protruding sheets; a U shape isolating plate clamping the two protecting plates and running across an opening of the long receiving chamber;

a metal fuse received in the seat and including two larger sheets and a meltable line for connecting the two sheets; a tenon being formed at each of the connections of the larger sheet and the meltable line; wherein in assembly, the metal fuse being received within the long receiving chamber and are spaced by the isolating plate so that the two tenons clamps the two sides of the isolating plate; an upper edge of each larger sheet is chamfered to have an inclined edge; a lowest edge of each inclined surface being formed with a transversally protruded buckle portion; each buckle portion having an upward extended nose; an outer side of each larger sheet is formed with outer chamfered surfaces and;

a rectangular bi-directional SMD form LED set being located on the buckle portions; the LED set being a coating device and being high temperature tolerant; the LED set being connected to a circuit; the LED including two LEDs and being serially connected with a voltage divided resistor; a fuse wire being connected between the LED set and a load; the LED set being buckled to the buckle portions; when the fuse wire breaks, light will emit out so as to show that the fuse wire breaks; thereby a break fuse can be fined rapidly; and a cover covering upon the seat; the cover having two symmetrical grooves so that the upper ends of the larger sheets of the metal fuse passing through openings of the groove, respectively; a middle section of the lower side of the cover being formed with a long slot for receiving the two rectangular ears; two sides of the slot being formed with two tenons, respectively; each tenon being formed with three edges so that the upper cover can be tightly closed;

wherein if one end of the circuit is connected to the positive side, one LED will conduct and light up as the fuse wire breaks; if another end of the circuit is connected to the positive side, another LED will conduct and light up as the fuse wire breaks; and wherein the seat and the cover are integrally formed; the LED set is adhered to the metal fuse and then the metal fuse is assembled into the long receiving chamber.

2. An insertion type fuse with breakage indication comprising:

a seat has a long receiving chamber; a middle section of the long receiving chamber being wider and two ends of the long receiving chamber being narrow; two opposite sides of the seat being two protecting plates; each protecting plate having a rectangular ear at an upper middle section thereof; another two opposite sides of the seat being formed with Y shape protruding sheets; a U shape isolating plate clamping the two protecting plates and running across an opening of the long receiving chamber;

a bottom cover having two posts at the inner two sides, a receiving chamber and buckling recess at lateral sides; the buckling cover having a plurality of hooks; the posts being installed with springs;

a bi-directional SMD LED set installed between the two springs so as to be received in the receiving chamber;

a metal fuse received within the seat and having two larger sheets; each larger sheet having a via hole for receiving the post so that the metal fuse being conductive to the springs;

a buckling cover having two through holes for receiving the two posts after passing through the two springs; the buckling cover having a plurality of buckling pins corresponding to the buckling recesses so that the pins can be received in the buckling recesses; and wherein if one end of the circuit is connected to the positive side, one LED will conduct and light up as the fuse wire breaks; if another end of the circuit is connected to the positive side, another LED will conduct and light up as the fuse wire breaks.

* * * * *